United States Patent [19]

Akimoto et al.

[11] Patent Number: 4,658,101

[45] Date of Patent: Apr. 14, 1987

[54] SLIDING-TYPE DIP SWITCH

[75] Inventors: Takashi Akimoto; Akio Kai; Masao Kobayashi; Haruo Itoh, all of Kanagawa, Japan

[73] Assignee: Teikoku Tsushin Kogyo Co., Ltd., Kanagawa, Japan

[21] Appl. No.: 830,885

[22] Filed: Feb. 19, 1986

[30] Foreign Application Priority Data

Feb. 28, 1985 [JP] Japan ..... 60-28970[U]

[51] Int. Cl.[4] ..... H01H 15/02

[52] U.S. Cl. ..... 200/16 R; 200/6 B; 200/16 D; 200/153 LA

[58] Field of Search ..... 200/1 R, 3 R, 6 R, 6 B, 200/6 C, 16 R, 16 C, 16 D, 153 L, 153 LA, 153 LB, 303

[56] References Cited

U.S. PATENT DOCUMENTS

| | | | |
|---|---|---|---|
| 3,622,934 | 11/1971 | Yano et al. | 200/153 LA X |
| 3,835,276 | 9/1974 | Field | 200/153 LA X |
| 3,883,705 | 5/1975 | Sebastian et al. | 200/6 B |
| 4,012,608 | 3/1977 | Lockard | 200/16 D |
| 4,117,280 | 9/1978 | Feaster | 200/6 B |
| 4,168,404 | 9/1979 | Lockard | 200/1 R |
| 4,191,867 | 3/1980 | Feaster | 200/16 R |
| 4,324,956 | 4/1982 | Sakakino et al. | 200/16 R |
| 4,326,110 | 4/1982 | Zdanys, Jr. | 200/16 R |
| 4,366,351 | 12/1982 | Ditzig | 200/153 LA X |
| 4,376,234 | 3/1983 | Liataud et al. | 200/16 R |
| 4,392,031 | 7/1983 | Curtis, III | 200/16 R |
| 4,454,391 | 6/1984 | Olsson | 200/16 D |

FOREIGN PATENT DOCUMENTS 58-115723 7/1983 Japan .

*Primary Examiner*—J. R. Scott

*Attorney, Agent, or Firm*—Wenderoth, Lind & Ponack

[57] ABSTRACT

A switch section of a sliding-type DIP switch includes a slider and a pair of opposing contacts each consisting of a resilient metal plate member and having a V-shaped urged portion and a linear portion connected to the urged portion. When the slider is slid, each opposing side wall thereof presses the distal end of the respective urge portion of one contact into contact with the linear portion of the other contact to achieve a reliable electrical switching action. A number of these contact pairs are integrated with the bottom portion of a housing by insert molding to facilitate fabrication.

2 Claims, 19 Drawing Figures

SLIDING-TYPE DIP SWITCH

BACKGROUND OF THE INVENTION

1. Field of the Invention

This invention relates to a sliding-type DIP switch and, more particularly, to a sliding-type DIP switch suitable for mounting on a printed circuit board for the purpose of switching electrical circuitry.

2. Description of the Prior Art

An example of a conventional DIP switch of the above type is described in the specification of Japanese Patent Application Laid-Open No. 57-165926 and is illustrated in the sectional view of FIG. 3 (*a*). As shown, the DIP switch includes a box-shaped housing 2 insert molded about a set of fixed terminals 1, 1 each formed from a metal member die-punched in advance. When the insert molding operation is performed, a free end of each fixed terminal 1 is held firmly in position in a molding die and is formed into a contact portion 1*a* by the action of the die. This contact portion 1*a* is exposed above the floor surface of the housing 2, with the arrangement being such that the contact portions 1*a*, *1a* of the respective fixed contacts 1, 1 oppose each other. A sliding contact 4 held by a slider 3 is slid back and forth between the opposing contact portions 1*a*, 1*a* to open and close these contacts, thereby performing a switching action.

Another example of the above-described DIP switch is described in the specification of Japanese Patent Application Laid-Open No. 56-45523 and illustrated in the sectional view of FIG. 3(*b*). As shown, the DIP switch includes a first base 12 in which a fixed contact terminal 11 is insert molded in advance, a second base 14 disposed on the first base 12 and in which a resilient movable contact terminal 13 having a movable contact 13*a* is insert molded in advance, and a slider 15 provided with a projecting portion 15*a*. The movable contact 13*a* is pressed against and released from the fixed contact terminal 11 by the projecting portion 15*a*, thereby closing and opening the switch.

The DIP switch having the structure shown in FIG. 3(*a*) is disadvantageous in terms of contact resistance and stability. Specifically, since the contact portion 1*a* of fixed terminal 1 is formed by the die for insert molding, it is necessary that a soft material capable of being molded be used as the material constituting the fixed terminal 1. Accordingly, self-actuation of the switch by relying upon its resilience is difficult, so that it is necessary to open and close the switch by a bridging or engaging-disengaging action performed by the separate contactor. Consequently, contact is made at a plurality of locations in series fashion, thus resulting in a large contact resistance. Furthermore, since the contact portion 1*a* is pressure molded by the molding die, contact instability is caused by the occurrence of scratches on the contact portion or by the adherence of dust or insulating substances such as the molding material to the contact partion. Another problem is the large number of component parts, which makes it difficult to assemble the switch.

The DIP switch having the structure shown in FIG. 3(*b*) is disadvantageous in that many man-hours of labor and a high manufacturing cost are demanded owing to the necessity of performing insert molding twice, namely once for the fixed contact terminal 11 and once for the movable contact terminal 13.

SUMMARY OF THE INVENTION

An object of the present invention is to provide a sliding-type DIP switch which solves the aforementioned problems encountered in the prior art.

Another object of the present invention is to provide a miniature sliding-type DIP switch having insert-molded terminals each equipped with a contact.

According to the present invention, the foregoing objects are attained by providing a sliding-type DIP switch having a housing, a plurality of sliders slidably accommodated in the housing and each having an upstanding actuating post projecting from an upper surface of the housing, a plurality of pairs of opposing contacts, two contacts in each pair being operatively associated with a corresponding one of the sliders of and engaged and disengaged by sliding the corresponding slider, and terminals connected directly to respective ones of the contacts in each pair and having respective distal ends arranged externally of the housing. Each contact of the pair of contacts is formed integral with the respective terminal by being die-punched, together with the terminal, from a resilient metal plate. The contact comprises a linear portion bent at a right angle with respect to the respective terminal, a generally V-shaped urged portion connected to the linear portion, and a contact portion formed by bending a distal end of the urged portion into an arcuate shape. Opposing ones of the contacts in each pair are fixedly arranged in parallel on an insulating plate. The housing is formed by insert molding in such a manner that the insulating plate having the pairs of terminals fixed thereon serves as the bottom portion of the housing. Each of the sliders has a lower portion which includes two opposing side walls defining a cavity spanning the corresponding pair of contacts, each side wall having a stepped section which narrows the cavity to urge the urged portion of a respective one of the contacts, and a generally V-shaped cut-out portion for releasing the urged portion. A click engagement mechanism is provided between the slider and a cover plate covering the same.

When one of the sliders is slid so that the peak of the V-shaped urged portion of each contact in the corresponding pair is urged by the respective stepped section of the slider side wall, each contact portion is pressed against the linear portion of the opposing contact to form a point of contact. Due to the pressure on the urged portion, the contact portion is caused to slide on the opposing linear portion and thus performs a cleaning action to assure stable contact at all times. If the slider is slid in the opposite direction, the peak of the V-shaped urged portion fits into the V-shaped cut-out provided in the respective slider side wall. When this occurs, the urged portion is restored to its original shape so that the contact portion separates from the linear portion of the opposing contact. At such time the contact portion slides on the linear portion and again performs the aforementioned cleaning action.

Other features and advantages of the present invention will be apparent from the following description taken in conjunction with the accompanying drawings, in which like reference characters designate the same or similar parts throughout the figures thereof.

Figure 1A:
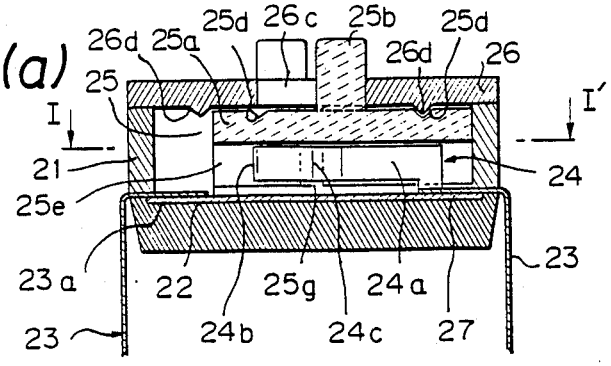
FIGS. 1(*a*)–1(*c*) illustrate the structure of a sliding-type DIP switch according to the present invention, in which FIG. 1(*a*) is a side view partially cut away, FIG.
Figure 1B:
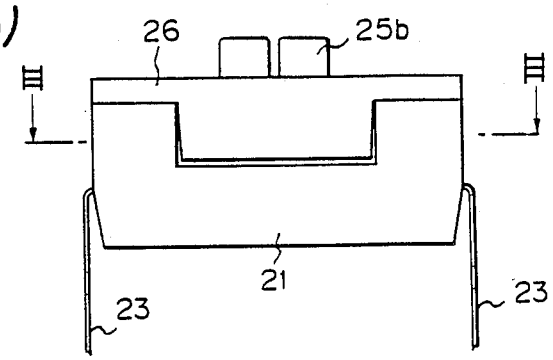
Figure 1C:
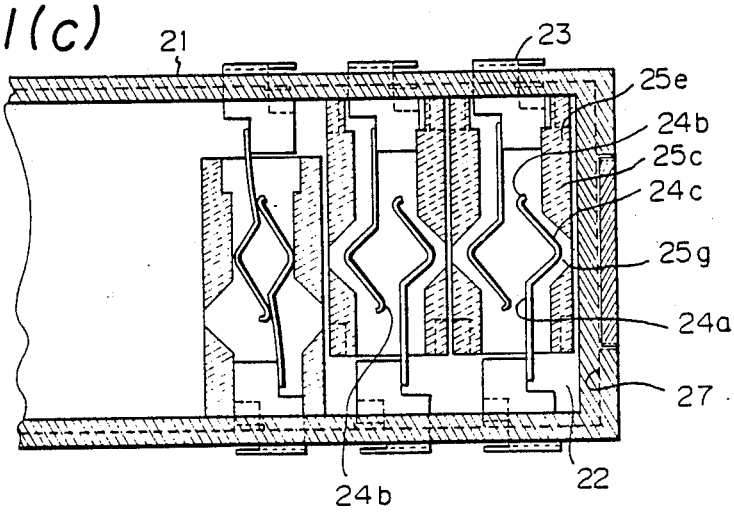
Figure 2A:
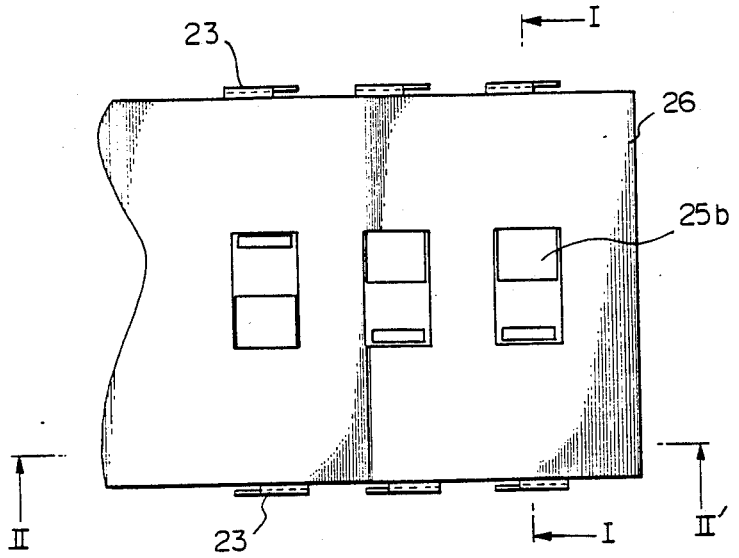
Figure 2B:
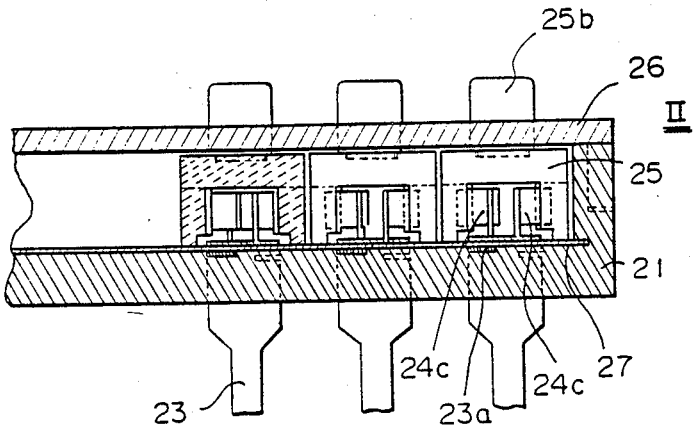

1(*b*) is a front view and FIG. 1(*c*) is a sectional view taken along line 1(*c*)–1(*c*) of FIG. 1(*a*);

FIG. 2(*a*) is a partial plan view of the Dip switch of FIG. 1.

Figure 3A:
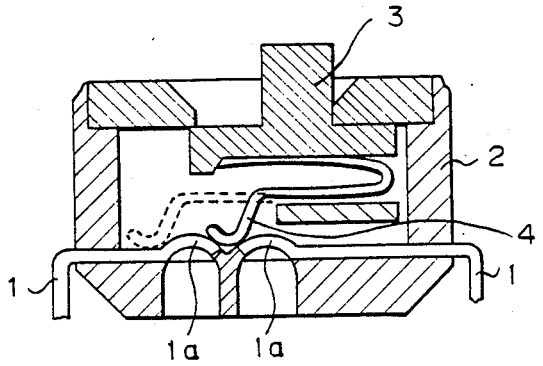
Figure 3B:
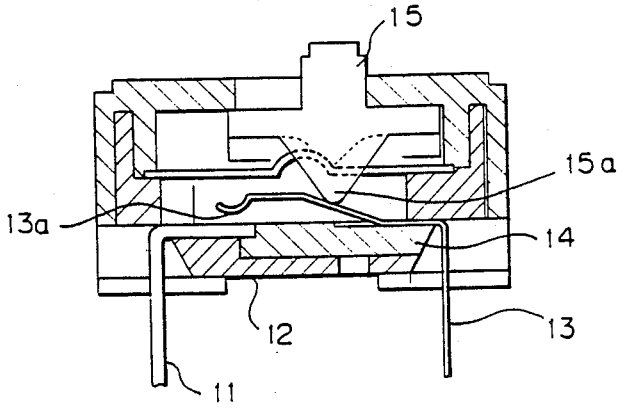
Figure 4:
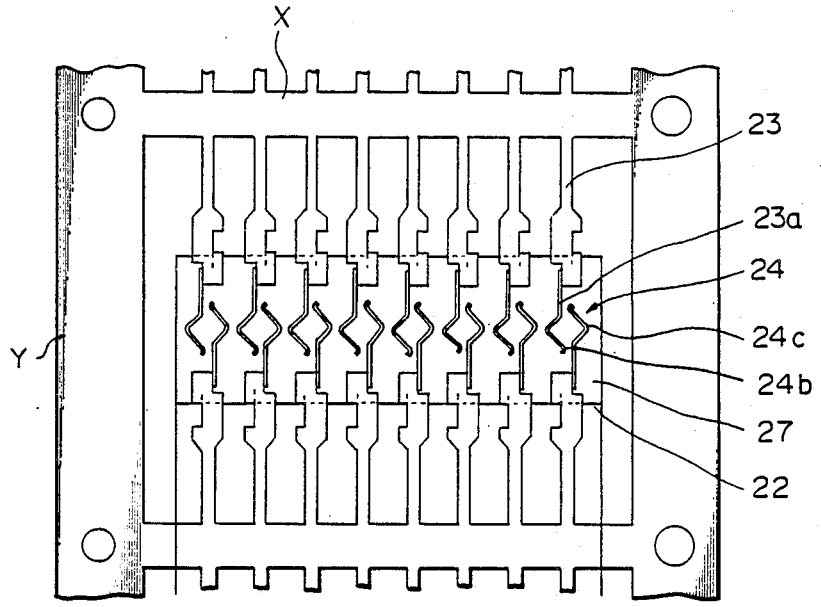
Figure 5:
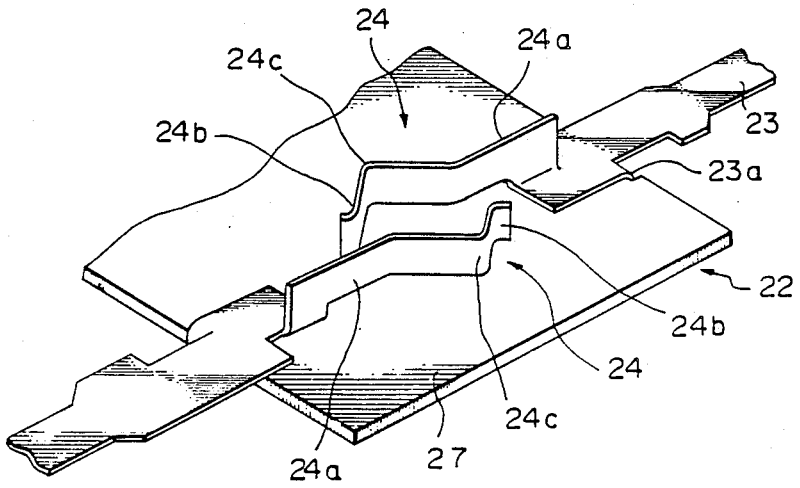
Figure 6:
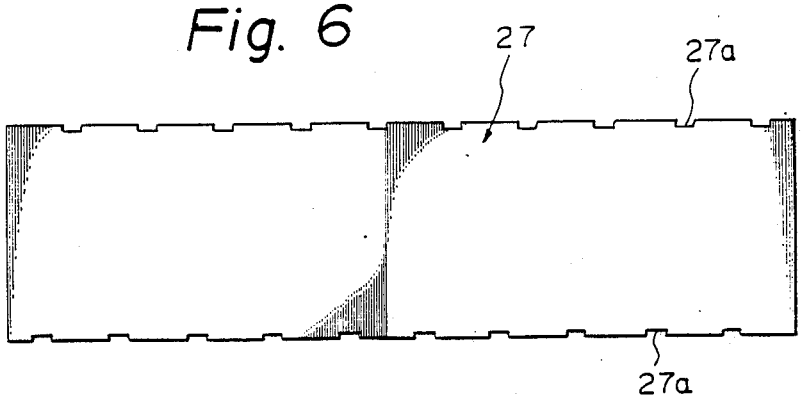
Figure 8A:
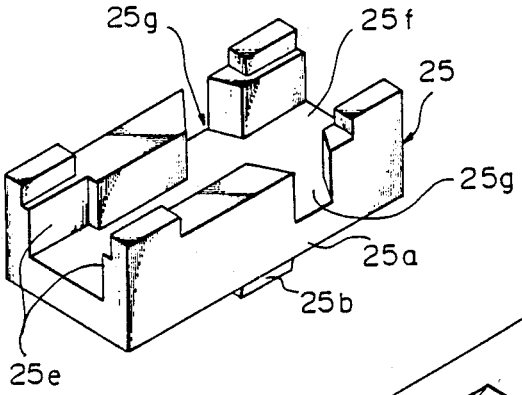
Figure 8B:
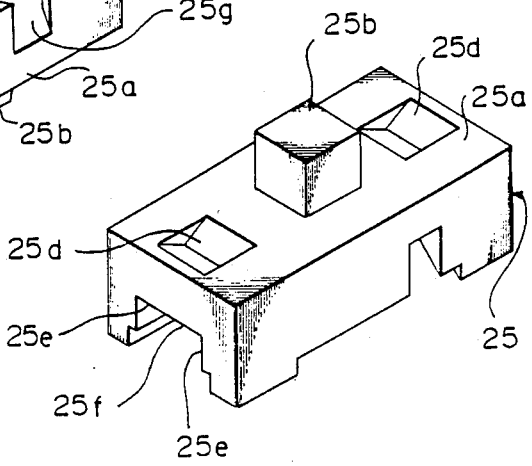
Figure 7B:
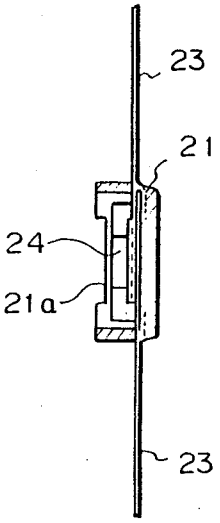
Figure 7A:
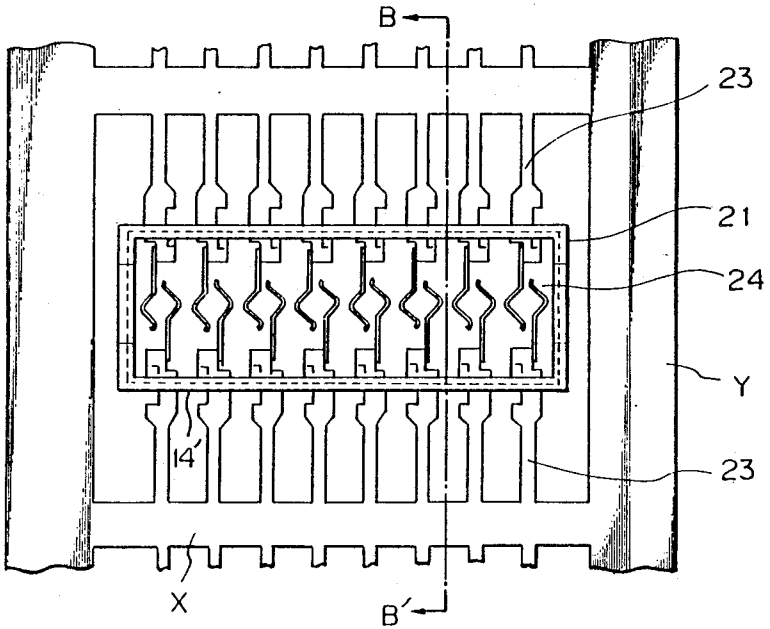
Figure 9A:
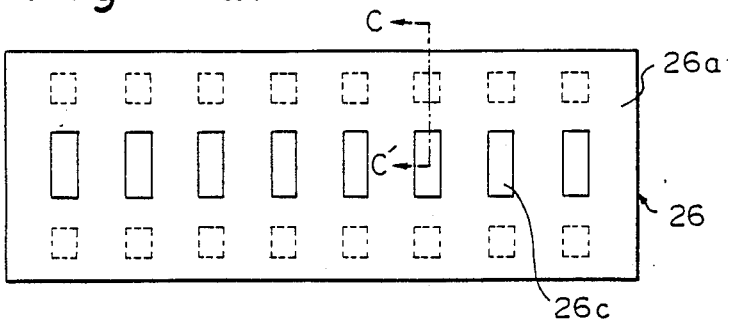
Figure 9B:
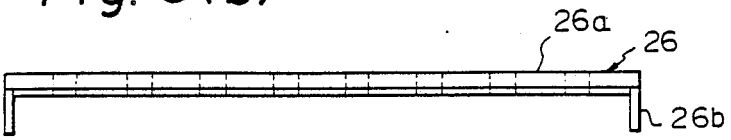
Figure 9C:
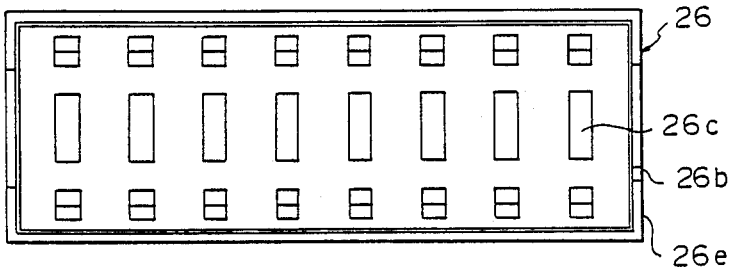
Figure 9D:
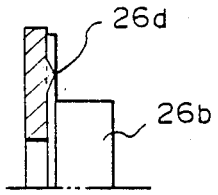
Figure 10:
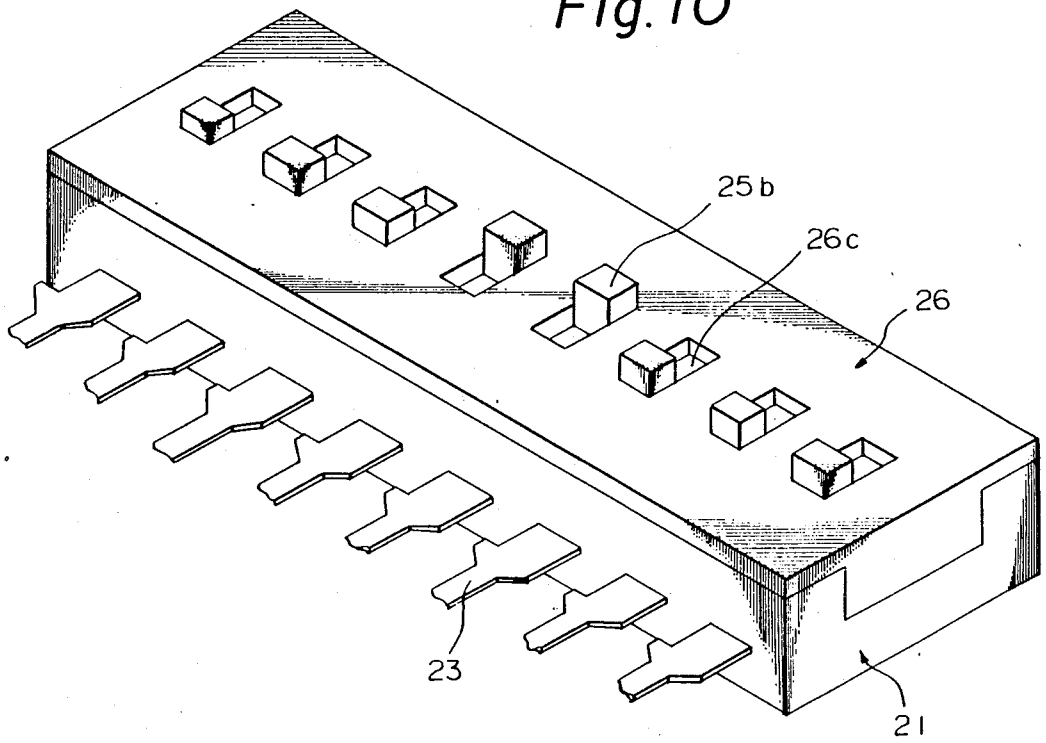

FIG. 2(*b*) is a sectional view of the Dip switch taken along line 2(*a*—2(*a*) of FIG. 2(*a*);

FIGS. 3(*a*) and 3(*b*) are sectional views each illustrating the structure of a sliding-type DIP switch according to the prior art;

FIG. 4 is a plan view illustrating the structure of a contact substrate of the DIP switch according to the present invention;

FIG. 5 is a partial plan view of the substrate of FIG. 4;

FIG. 6 is a plan view showing the shape of an insulating plate of the DIP switch according to the present invention;

FIGS. 7(*a*) and 7(*b*) illustrate the structure of a housing of the DIP switch according to the present invention in which a contact substrate is insert molded, wherein FIG. 7(*a*) is a plan view and FIG. 7(*b*) is a sectional view taken along line 7(*b*)—7(*b*) of FIG. 7(*a*);

FIGS. 8(*a*) and 8(*b*) illustrate the structure of a slider, in which FIG. 8(*a*) is a perspective view of the slider as seen from below and FIG. 8(*b*) is a perspective view of the slider as seen from above;

FIGS. 9(*a*)–9(*d*) illustrate a cover plate of the DIP switch according to the present invention in which FIG. 9(*a*) is a plan view, FIG. 9(*b*) is a front view, FIG. 9(*c*) is a bottom view and FIGS. 9(*d*) is a sectional view taken along line 9(*d*)—9(*d*) of FIG. 9(*a*); and FIG. 10 is a perspective view illustrating the external appearance of the assembly sliding-type DIP switch according to the present invention.

DESCRIPTION OF THE PREFERRED EMBODIMENT

An embodiment of the present invention will now be described with reference to the drawings.

A sliding-type DIP switch according to the present invention is illustrated in FIGS. 1(*a*)–1(*c*) which FIG. 1(*a*) is a side section, partially cut away FIG. 1(*b*) is a front view and FIG. 1(*c*) is a sectional plan view, partially broken away, taken along line 1(*c*)—1(*c*) of FIG. 1(*a*). The sliding-type DIP switch comprises a housing 21, a contact substrate 22 associated with a pair of terminals 23, a pair of contacts 24 corresponding to the terminals 23 and an insulating plate 27, a slider 25 and a cover plate 26. Each terminal 23 and its corresponding contact 24 are die-punched into a predetermined shape from a resilient metal plate. The terminal 23 and contact 24 are thus formed integral with each other, with the portion corresponding to the contact 24 being bent at a right angle with respect to the portion corresponding to the terminal 23. The contact 24 further includes a linear portion **24*a* connected to the terminal 23, an urged portion 24*c* contiguous to the linear portion 24*a* and formed by bending the contact into a generally V-shaped configuration, and a contact portion 24*b* at the distal end of the urged portions 24*c* and formed by bending this end of the contact into an arcuate configuration. The terminal 23 is formed to include a finger 23*a* which engages the underside of the insulating plate 27. As will be described in detail below, the terminal 23 and its finger 23*a* grip the insulating plate 27 firmly to rigidly unite the terminal 23, contact 24 and insulating plate 27 into a single body, thus forming the aforementioned contact substrate 22. The contact substrate 22 is insert molded in a resin material to be disposed as the bottom portion of the housing 21**.

As will be set forth in detail below, the slider 25 has an integrated construction which includes a slider body **25*a* having an upper portion formed to include a single actuating post 25*b*, and a lower portion formed to include two opposing side wall portions 25*e*. Confronting portions of the opposing side walls 25*e* are each provided with a V-shaped recess to form a generally rhombic cavity 25*g* for accommodating the urged portion 24*c* of the respective contact 24**.

The cover plate 26 is shaped to fit on the upper portion of the housing 21. The upper portion of the cover plate 26 has a rectangular slot **26*c* through which the actuating post 25*b* of slider 25 projects so that the post 25*b* can be slid back and forth. The lower side of the cover plate 26 is formed to include click projections 26*d* at each end for engaging with corresponding notches 25*d* provided in the upper side of the slider 25**.

The slider 25 in the DIP switch having the foregoing structure is slid back and forth by manipulating the actuating post **25*b*. When the slider 25** is moved back, i.e., upward in FIG. 1(*c*), the urged portions **24*c*, 24*c* of the respective contacts 24, 24 are situated in the respective cavities 25*g* of the slider 25 so that the contact portion 24*b* of each contact 24 separates from the linear portion 24*a* of the opposing contact 24, thus placing the DIP switch in an open state. When the slider 25** is moved forward, i.e., downward in FIG. 1(*c*), the urged portion **24*c* of each contact 24 is urged toward the opposing urged portion 24*c* by the side surface of a stepped section 25*c* of the corresponding side wall 25*e* of slider 25, so that the contact portion 24*b* of each contact 24 contacts the linear portion 24*a* of the opposing contact 24, thus placing the DIP switch in a closed state. Note that when the slider 25 is moved back and forth in the above manner, the above-described click engagement between the cover plate 26 and slider 25** shifts from one side of the slider to the other.

When the DIP switch is opened and closed as described above, each contact portion **24*b* slides on the opposing linear portion 24*a*. This sliding motion causes the contacting portions to be cleaned and to be maintained free of contamination at all times, thus affording stable contact. Furthermore, since the two contact portions 24*b* contact the two opposing linear portions 24*a*, contact is effected at two locations in parallel fashion. This is equivalent to connecting the contact resistances at the respective points of contact in parallel, so that the resultant contact resistance is very small. In addition, since the click projection 26*d* of cover plate 26 is held in engagement with the corresponding notch 25*d* in the slider 25 at one or the other end of the slider, stable contact is obtained since there is no vibration-induced movement of the slider 25**.

Let us now describe in detail the configuration and structure of the housing 21, contact substrate 22, terminal 23, contact 24, slider 25 and cover plate 26.

As shown in the plan view of FIG. 4 depicting the contact substrate 22 in the switch according to the present invention and the partial perspective view of FIG. 5, the contact 24 and terminal 23 are die-punched from a resilient metal plate and are formed as an integral portion of interconnected frames X and Y extending transversely and longitudinally, respectively. The body comprising the terminals 23, contacts 24 and frames X, Y shall be referred to as a contact plate hereafter. After being die-punched from the metal plate into a predetermined shape, the contact 24 is bent at a right angle with respect to the terminal 23. The contact 24 comprises the linear portion 24*a* connected to the terminal 23 via the bent base portion, the urged portion 24*c* connected to the linear portion 24*a* and bent into the V-shaped configuration, and the contact portion 24*b* formed by bending the distal end of the pressed portion 24*c* into the arcuate configuration. A portion of one longitudinal side edge of the terminal 23 is cut to form the finger 23*a*, which is bent downward and then under the terminal proper to form a gap between itself and the bottom of the terminal. Two contacts 24, 24 of the above construction are positioned to oppose each other so that a generally diamond-shaped space is formed between the urged portions 24*c*, 24*c* each of which has the V-style shape. The pair of contacts 24 and their corresponding terminals 23 form one set. A plurality of these sets formed into an integrated unit by the interconnected frames X, Y are then placed on the insulating plate 27 and the opposing side edge portions of the insulating plate 27 are inserted into the gaps formed between the respective fingers 23*a* and the bottom of the corresponding terminals 23. The contact substrate 22 is thus assembled. When the substrate 22 is in the assembled state, the bottom edge of each contact 24 is slightly higher than the upper surface of the terminal 23 and therefore can be shifted back and forth without touching the upper surface of the insulating plate 27.

FIG. 6 is a plan view showing the insulating plate 27 according to the present invention. The insulating plate 27 consists of a plate-shaped electrical insulator the opposing longitudinal edges of which are provided with notches 27*a* for engaging with corresponding ones of the fingers 23*a* provided on the edges of the terminals 23. The aforementioned contact plate and the insulating plate 27 are combined by engaging the fingers 23*a* with the corresponding notches 27*a*, thereby assembling the contact substrate 22 shown in FIG. 4.

FIG. 7(*a*) is a plan view illustrating the generally box-shaped housing 21 having the insulating plate 27 of the contact substrate 22 insert molded into its bottom portion. FIG. 7(*b*) is a sectional view taken along line 7(*b*)—7(*b*) of FIG. 7(*a*). As shown, a group of the contacts 24 upstand in an exposed state from the bottom portion of the housing 21, and a group of the terminals 23 extend in an exposed state from the opposing side surfaces of the bottom portion. The interconnected longitudinal and transverse frames Y, X of the contact plate are cut away after the insert molding operation and the terminals 23 are bent vertically downward at the outer side of the housing 21 to facilitate mounting on a printed circuit board. The left and right side walls of the housing 21 are provided with recesses 21*a* engaged by corresponding vertically depending walls of the cover plate 26, as described below.

FIGS. 8(*a*) and 8(*b*) illustrate the structure of the slider 25, in which FIG. 8(*a*) is a perspective view of the slider as seen from below and FIG. 8(*b*) is a perspective view of the slider as seen from above. The slider 25 has a generally U-shaped cross section and includes the body 25*a*. The upper surface of body 25*a* is provided with the upstanding actuating post 25*b* that protrudes to the outside of the cover plate 26 through the rectangular slot 26*c* in cover plate 26, and having the two notches 25*d* that engage with the corresponding projections on the cover plate 26. The side walls 25*e* depend from two opposing sides of the body 25*a* to form a cavity 25*f*. The inner side of each side wall 25*e* is provided with the stepped section 25*c* which narrows the width of the cavity 25*f*. Provided in each side wall 25*e* adjacent to the stepped section 25*c* is a generally V-shaped cut-out the apex whereof is open to the outside of the slider. The oblique surfaces having a V-shaped cut-out define the cavity 25*g* of generally rhombic shape. The slider 25 slidably spans the pair of contacts 24, 24 by virtue of the cavity 25*f* formed between the side walls 25*e*. When the peak of each urged portion 24*c* of the respective contact 24 engages the stepped section 25*c* of the corresponding side wall 25*e*, the contact portion 24*b* is brought into contact with the linear portion 24*a* of the opposing contact 24. When the peak of the urged portion 24*c* occupies the cavity 25*g* defined by the V-shaped cut-out, the contact portion 24*b* separates from the linear portion 24*a* due to its own resiliency.

FIGS. 9(*a*)–9(*d*) illustrate the cover plate 26, in which FIG. 9(*a*) is a plan view, FIG. 9(*b*) is a front view, FIG. 9(*c*) is a bottom view and FIG. 9(*d*) is a sectional view taken along line 9(*d*)—9(*d*) of FIG. 9(*a*). The cover plate 26 having a generally flat configuration includes a cover body 26*a* from the left and right side edges of which project depending walls 26*b* for engaging with the corresponding recesses 21*a* of the housing 21. The planar portion of the cover body 26*a* is provided with a plurality of the rectangular slots 26*c* at positions corresponding to the contacts 24. The rectangular slots 26*c* are arranged in parallel in a single row and slidably receive the corresponding actuating posts 25*b* of the sliders 25. As described above in connection with FIGS. 9(*a*)–9(*d*), the lower portion of the planar section of cover body 26*a* is provided with the projections 26*d* for click engagement with the corresponding notches 25*d* provided in the upper surface of slider body 25*a*. A rib 26*e* for ultrasonic welding is provided along the outer periphery of the cover body 26*a* on its lower surface. The cover plate 26 is accommodated in the housing 21 together with the sliders 25 and contacts 24 and is fixedly secured to the upper portion of the housing 21 by ultrasonic welding along the rib 26*e*.

FIG. 10 is a perspective view showing the external appearance of the sliding-type DIP switch assembled in the manner set forth above. Each section of the DIP switch is opened and closed by sliding the actuating post 25*b*, which projects from the upper portion of the cover plate 26, along the corresponding rectangular slot 26*c*.

In accordance with the illustrated embodiment, a number of the contacts 24 are attached to the insulating plate 27 while being retained by the interconnected frames X, Y. The contacts 24 are then fixed in position by forming the wall and bottom portions of the housing 21 about the insulating plate by means of insert molding. Accordingly, in a case where a number of contact groups are to be assembled at one time, the position at which each contact is disposed can be accurately maintained to make possible the very simple assembly of even miniature DIP switches. In addition, since each switch section of the DIP switch is constituted by a pair of the contacts, contact resistance is reduced in comparison with the prior art of FIG. 3(*a*), which employs a separate contactor. Furthermore, since the linear portion 24*a* of one contact 24 touches the contact portion 24*b* of the other, the two contacts 24 of the pair contact each other at two points in the manner of a parallel connection, thereby reducing contact resistance and enhancing contact reliability over the prior-art arrangement in which contact is obtained at only one point. Moreover, each time a switch section of the DIP switch is actuated, the opposing contacts clean each other to provide more stable contact. Since the DIP switch is sealed tightly by the ultrasonically welded housing 21 and cover plate 26, there is no danger of dust or other contaminants invading the interior of the switch. This assures even greater reliability of operation.

Further, with conventional DIP switches having the structures of the type shown in FIGS. 3(*a*) and 3(*b*), there is the danger that gaps will form between the molded housing and the terminal members when there is a sudden rise in temperature when soldered. The gaps result due to a difference in thermal expansion between the terminal members and the molding material constituting the housing. Such gaps would permit the invasion of molten solder or flux, which might then reach the coplanar contact and terminal portions. This would tend to cause contact failure. With the present invention, on the other hand, the contact portions are not flush with the terminal portions but are disposed at a higher level, thus eliminating or greatly reducing the possibility of such contact failure.

Since the DIP switch of the present invention has few component parts and is easy to assemble, mass production is possible at a low cost.

Thus, the sliding-type DIP switch of the present invention has a number of significant advantages. Specifically, when the pressed portions of opposing contacts are urged by the side walls of the corresponding slider, the opposing contact portions touch each other at two locations in the manner of a parallel connection. The result is a much lower contact resistance. Since the contact portions slide against each other in the process of engaging and disengaging, these portions undergo a cleaning action so that good contact can be made stably at all times. Furthermore, since the switch is of the tightly sealed type, operating reliability is enhanced because there is no risk of penetration by contaminants such as dust. Due to the small number of component parts and ease of assembly, moreover, manufacturing costs are significantly reduced.

As many apparently widely different embodiments of the present invention can be made without departing from the spirit and scope thereof, it is to be understood that the invention is not limited to the specific embodiments thereof except as defined in the appended claims.

What is claimed is:

1. A sliding-type DIP switch comprising:

a housing having a bottom portion, first and second spaced apart and opposed side wall portions extending from said bottom portion, a pair of spaced apart and opposed end wall portions extending from said bottom portion between said first and second opposed side wall portions, and a cover plate provided opposite said bottom portion on said wall portions, said cover plate having at least one slot means extending therethrough, said slot means extending in a direction between said side wall means;

a pair of opposing contacts each of which extends from said housing at said first and second side wall portions respectively and has a free end, one of said pair of opposing contacts having a first portion extending from said housing at said first side wall portion, an urged portion bent away from and then towards the other opposing contact and a contact portion extending from said urged portion terminating at the free end of said one contact, said other contact having a first portion extending from said housing at said second side wall portion of said housing, an urged portion bent away from and then towards said one contact and a contact portion extending from said urged portion thereof terminating at the free end thereof;

a slider slidably mounted to said housing for sliding in said direction in which said slot means extends, said slider having a lower portion located in said housing, said lower portion comprising first and second spaced apart and opposed side walls defining a cavity therebetween through which said opposing pair of contacts extend, each of said first and second side walls having a recess open to said cavity, said slider being slidable between a first position adjacent said first side wall portion of said housing in which said urged portions of said opposing pair of contacts are situated in a respective said recess of each of said side walls of said slider and said pair of opposing contacts do not contact each other to a second position adjacent said second side wall portion of said housing in which said urged portions of said opposing contacts are each engaged by a respective one of said side walls of said slider for urging each of said pair of opposing contacts towards one another such that each contact portion of said pair of opposing contacts makes contact with said first portion of the opposing contact; and a respective terminal connected at one end thereof to each of said first portions of said opposing contacts.

2. A sliding-type DIP switch as claimed in claim 1 wherein, said bottom portion comprises a bottom wall having an insulating plate insert molded thereto, said insulating plate located directly beneath said pair of opposing contacts; and said contacts being integral with said terminals and extending transversely thereto, said contacts each further comprising a finger integrally formed therewith and located between said insulating plate and said bottom wall portion for securing said contacts to said insulating plate and said housing.

* * * * *